US009081404B2

(12) United States Patent
Jackum et al.

(10) Patent No.: US 9,081,404 B2
(45) Date of Patent: Jul. 14, 2015

(54) VOLTAGE REGULATOR HAVING INPUT STAGE AND CURRENT MIRROR

(75) Inventors: Thomas Jackum, Gleisdorf (AT); Frank Praemassing, Ratingen (DE); Stefan Berger, Moosburg (AT); Elmar Bach, Villach (AT); Albert Missoni, Graz (AT)

(73) Assignee: Infineon Technologies Austria AG, Villach (AT)

( * ) Notice: Subject to any disclaimer, the term of this patent is extended or adjusted under 35 U.S.C. 154(b) by 588 days.

(21) Appl. No.: 13/446,890

(22) Filed: Apr. 13, 2012

(65) Prior Publication Data

US 2013/0271095 A1 Oct. 17, 2013

(51) Int. Cl.
*G05F 1/563* (2006.01)
*G05F 1/56* (2006.01)

(52) U.S. Cl.
CPC ..... *G05F 1/56* (2013.01)

(58) Field of Classification Search
USPC ..... 323/281–282, 284–285, 288–289, 323/311–317
See application file for complete search history.

(56) References Cited

U.S. PATENT DOCUMENTS

| | | | | |
|---|---|---|---|---|
| 5,861,736 | A * | 1/1999 | Corsi et al. | 323/273 |
| 6,714,081 | B1 * | 3/2004 | Xu | 330/296 |
| 7,482,790 | B2 * | 1/2009 | Eberlein | 323/270 |
| 7,498,780 | B2 | 3/2009 | Chen et al. | |
| 7,750,724 | B2 * | 7/2010 | Rengachari et al. | 327/538 |
| 7,990,106 | B2 * | 8/2011 | Hussain et al. | 320/128 |
| 8,217,684 | B2 * | 7/2012 | Yuh et al. | 327/108 |
| 8,278,893 | B2 * | 10/2012 | Motz | 323/273 |
| 2010/0013448 | A1 * | 1/2010 | Motz | 323/280 |
| 2011/0298435 | A1 * | 12/2011 | Homol et al. | 323/282 |
| 2013/0134954 | A1 * | 5/2013 | Yano et al. | 323/282 |

FOREIGN PATENT DOCUMENTS

| | | | |
|---|---|---|---|
| CN | 1932710 | A | 3/2007 |
| CN | 101295189 | A | 10/2008 |
| CN | 101419479 | A | 4/2009 |
| CN | 102385406 | A | 3/2012 |
| EP | 2372485 | A1 | 10/2011 |

OTHER PUBLICATIONS

Guo, J., et al., "A 6-μ W Chip-Area-Efficient Output-Capacitorless LDO in 90-nm CMOS Technology," IEEE Journal of Solid-State Circuits, vol. 45, No. 9, Sep. 2010, pp. 1896-1905.

(Continued)

*Primary Examiner* — Adolf Berhane
*Assistant Examiner* — Nusrat Quddus
(74) *Attorney, Agent, or Firm* — Slater & Matsil, L.L.P.

(57) ABSTRACT

A voltage regulator includes an output stage including a control terminal and a load path, with the load path coupled between the input terminal and the output terminal. The voltage regulator also includes a control circuit with an input stage, a first current mirror, and a second current mirror. The input stage includes a first control input configured to receive a first reference voltage, a second control input configured to receive a second reference voltage, a feedback input coupled to the output terminal, a first output terminal, and a second output terminal. The first current mirror includes a reference current path coupled between a first supply terminal and the first output terminal of the input stage, and an output current path coupled between the first supply terminal and the control terminal of the pass device.

14 Claims, 4 Drawing Sheets

(56) References Cited

OTHER PUBLICATIONS

Hazucha, P., et al., "Area-Efficient Linear Regulator With Ultra-Fast Load Regulation," IEEE Journal of Solid-State Circuits, vol. 40, No. 4, Apr. 2005, pp. 933-940.

Jackum,T., et al., "Fast Transient Response Capacitor-Free Linear Voltage Regulator in 65nm CMOS," 2011 IEEE International Symposium on Circuits and Systems (ISCAS), May 15-18, 2011, pp. 905-908.

* cited by examiner

VOLTAGE REGULATOR HAVING INPUT STAGE AND CURRENT MIRROR

TECHNICAL FIELD

Embodiments of the present invention relate to a linear voltage regulator, in particular, a voltage regulator without an off-chip output capacitance (a capless voltage regulator).

BACKGROUND

Many electronic devices, such as, e.g., microcontrollers, central processing units (CPU), memory devices, and the like, require a defined supply voltage. A linear voltage regulator can be used to provide such a defined supply voltage from an input voltage that is higher than the desired supply voltage. A linear voltage regulator includes a pass device, such as a transistor, connected between a supply input for receiving the input voltage and an output for providing the defined supply voltage to a load. A control circuit controls the pass device such that the supply voltage corresponds to a desired voltage.

The voltage regulator should be capable of responding quickly to variations of the load that may cause variations of the output voltage. Conventional linear voltage regulators include a large off-chip output capacitor connected to the output of the voltage regulator. Large capacitors, however, are difficult to implement in integrated circuits, and the provision of an external (discrete) capacitor would increase the costs.

There is therefore a need to provide a linear voltage regulator that is fast and that does not require an external output capacitor.

SUMMARY OF THE INVENTION

A first embodiment relates to a voltage regulator. The voltage regulator includes an output terminal for providing an output voltage, an input terminal for receiving an input voltage supply potential, and an output stage including a control terminal and a load path, with the load path coupled between the input terminal and the output terminal. The voltage regulator further comprises a control circuit with an input stage, a first current mirror, and a second current mirror. The input stage includes a first control input configured to receive a first reference voltage, a second control input configured to receive a second reference voltage, a feedback input coupled to the output terminal, a first output terminal, and a second output terminal. The first current mirror includes a reference current path coupled between a first supply terminal and the first output terminal of the input stage, and an output current path coupled between the first supply terminal and the control terminal of the pass device. The second current mirror includes a reference current path coupled between a second supply terminal and the second output of the input stage, and an output current path coupled between the second supply terminal and the control terminal of the pass device. The input stage is configured to control a current through the reference current path of the first current mirror dependent on a voltage between the first control terminal and the feedback terminal, and to control a current through the reference current path of the second current mirror dependent on a voltage between the second control terminal and the feedback terminal.

BRIEF DESCRIPTION OF THE DRAWINGS

Examples will now be explained with reference to the drawings. The drawings serve to illustrate the basic principle, so that only aspects necessary for understanding the basic principles are illustrated. The drawings are not to scale. In the drawings the same reference characters denote like features.

DETAILED DESCRIPTION OF ILLUSTRATIVE EMBODIMENTS

In the following detailed description, reference is made to the accompanying drawings, which form a part thereof, and in which is shown by way of illustration specific embodiments in which the invention may be practiced.

Figure 1:
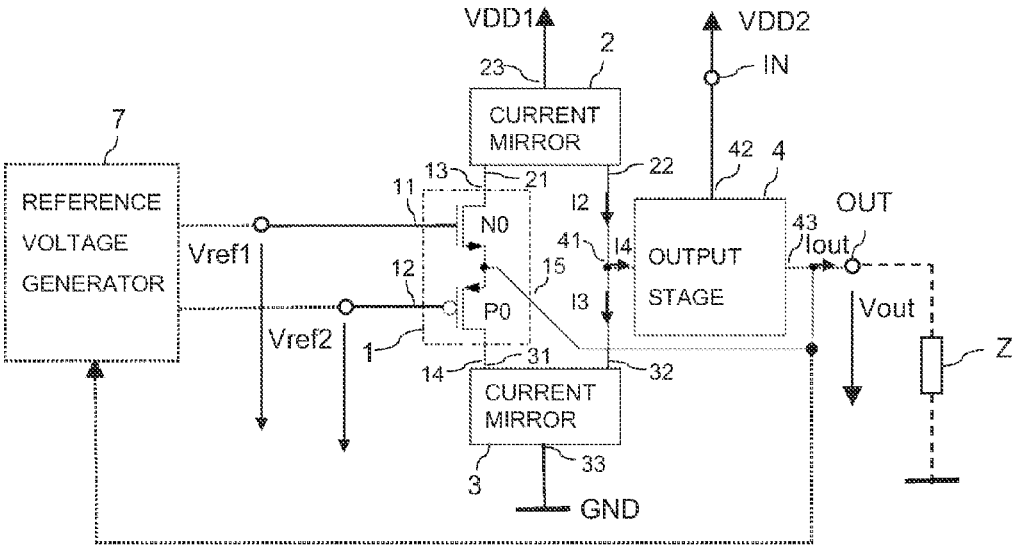
FIG. 1 illustrates a first embodiment of a linear voltage regulator including an input stage, a first current mirror, a second current mirror and an output stage.

FIG. 1 illustrates a first embodiment of a voltage regulator, in particular, of a linear voltage regulator without an off-chip output capacitor. This type of voltage regulator will be referred to as a "capless" linear voltage regulator in the following. Referring to FIG. 1, the voltage regulator includes an output terminal OUT for providing an output voltage Vout, and an input terminal IN for receiving an input voltage VDD2. In the embodiment illustrated in FIG. 1, the input voltage VDD2 and the output voltage Vout are voltages that are referenced to a reference potential GND, such as, e.g., ground. An output stage 4 with a control terminal 41 and with a load path between a first load terminal 42 and a second load terminal 43 has its load path 42-43 coupled between the input terminal IN and the output terminal OUT. The output stage 4 is controlled by a control circuit and is configured to generate the output voltage Vout from the input voltage VDD2 as controlled by the control circuit. The output voltage Vout provided by the output terminal OUT may be supplied to a load Z (illustrated in dashed lines in FIG. 1). This load Z may be any type of load requiring a controlled supply voltage, such as the output voltage Vout provided by the voltage regulator. In the embodiment illustrated in FIG. 1, the load Z is coupled between the output terminal OUT and the terminal for the reference potential GND. However, this is only an example. Dependent on the type of output stage 4 the load could also be connected between output terminal OUT and the terminal for the input voltage VDD2.

The control circuit that controls the output stage 4 includes an input stage 1, a first current mirror 2, and a second current mirror 3. The input stage 1 comprises a first control input 11 configured to receive a first reference voltage Vref1, a second control input 12 configured to receive a second reference voltage Vref2, a feedback input 15 coupled to the output terminal OUT, a first output terminal 13, and a second output terminal 14. The first current mirror 2 includes a reference current path coupled between a first supply terminal of the control circuit and the first output terminal 13 of the input stage 1, and an output current path coupled between the first supply terminal of the control circuit and the control terminal 41 of the output stage 4. The second current mirror 3 includes a reference current path coupled between a second supply terminal of the control circuit and the second output terminal 14 of the input stage 1, and an output current path coupled between the second supply terminal of the control circuit and the control terminal 41 of the output stage 4. The first and second supply terminals of the control circuit serve to receive a supply voltage. In the embodiment illustrated in FIG. 2, the second supply terminal is coupled to the terminal for the reference potential GND, and the first supply terminal receives a supply voltage VDD1 referenced to the reference potential GND. The magnitude of the supply voltage VDD1 is dependent on the implementation of the control circuit and the desired output voltage. The supply voltage VDD1 is, for example, 5V, 3.3V or 1.2V. The input voltage VDD2 from which the output voltage Vout is generated, is dependent on the desired output voltage Vout.

Each of the first and second current mirrors 2, 3 has a reference terminal 21, 31, an output terminal 22, 32 and a supply terminal 23, 33. The reference current paths of the first and second current mirrors 2, 3 are between the corresponding reference terminal 21, 31 and the supply terminal 23, 33, and the output current paths of the first and second current mirrors 2, 3 are between the corresponding output terminals 22, 32 and the supply terminal 23, 33. Thus, the reference terminal 21 of the first current mirror 2 is coupled to the first output terminal 13 of the input stage 1, the output terminal 22 of the first current mirror 2 is coupled to the control terminal 41 of the output stage 4, and the supply terminal 23 of the first current mirror 2 is coupled to the first supply terminal of the control circuit. Equivalently, the reference terminal 31 of the second current mirror 3 is coupled to the second output terminal 14 of the input stage 1, the output terminal 32 of the second current mirror 3 is coupled to the control terminal 41 of the output stage 4, and the supply terminal 33 of the second current mirror 3 is coupled to the second supply terminal of the control circuit.

The input stage 1 is configured to control a current through the reference current path 13-23 of the first current mirror 2 dependent on a voltage between the first control terminal 11 and the feedback terminal 15, and is configured to control a current through the reference current path 31-33 of the second current mirror 3 dependent on a voltage between the second control terminal 12 and the feedback terminal 15. Output currents I2, I3 of the first and second current mirrors 2, 3 are currents at the output terminals 22, 32. The output current I2, I3 of each current mirror 2, 3 is dependent on the current through the reference current path of the corresponding current mirror 2, 3.

In the embodiment illustrated in FIG. 1, the input stage 1 includes a first transistor N0 with a control terminal coupled to the first control input 11 of the input stage 1, and with a load path coupled between the first output terminal 13 and the feedback input 15 of the input stage 1. Further, the input stage 1 includes a second transistor P0 with a control terminal coupled to the second control input 12, and with a load path coupled between the second output terminal 14 and the feedback input 15. In the embodiment illustrated in FIG. 1, the first and second transistors N0, P0 are implemented as MOS transistors each having a gate terminal as a control terminal, and a drain-source path as a load path. Specifically, the first and second transistors N0, P0 are implemented as complementary MOS transistors, wherein in the embodiment of FIG. 1, the first transistor N0 is an NMOS transistor and the second transistor P0 is a PMOS transistor. Each of these transistors N0, P0 has its source terminal coupled to the feedback input 15. The drain terminal of the first transistor N0 is coupled to the first output terminal 13, and the drain terminal of the second transistor P0 is coupled to the second output terminal 14.

Implementing the first and second transistors N0, P0 of the input stage 1 as MOS transistors is only an example. These transistors could also be implemented as bipolar transistors (bipolar junction transistors, BJT) each having a base terminal, a collector terminal and an emitter terminal. The base terminal of a bipolar transistor corresponds to the gate terminal of a MOS transistor, the collector terminal of a bipolar transistor corresponds to the drain terminal of a MOS transistor, and the emitter terminal of a bipolar transistor corresponds to the source terminal of a MOS transistor. In the voltage regulator of FIG. 1, the first input stage 1 would be implemented with bipolar transistors, the first transistor N0 of FIG. 1 would be replaced by an NPN bipolar transistor, and the second transistor P0 would be replaced by a PNP bipolar transistor.

The operating principle of the voltage regulator of FIG. 1 is explained below. In the voltage regulator of FIG. 1, a voltage between the first control input 11 and the feedback input 15 corresponds to the gate-source voltage of the first transistor N0. Equivalently, the voltage between the second control input 12 and the feedback input 15 corresponds to the gate-source voltage of the second transistor P0. A current through the first transistor N0 and, therefore, a current through the reference current path 13-23 of the first current mirror 2 is dependent on the voltage difference Vref1-Vout between the first reference voltage Vref1 and the output voltage Vout. Equivalently, the current through the second transistor P0 and, therefore, the current through the reference current path of the second current mirror 3 is dependent on the gate-source voltage of the second transistor P0, which corresponds to the voltage difference Vref2-Vout between the second reference voltage Vref2 and the output voltage Vout. The first and second reference voltages Vref1, Vref2 are different, wherein the first reference voltage Vref1 is higher than the second reference voltage Vref2, i.e., Vref1>Vref2. In the steady state of the voltage regulator, the output voltage Vout is a voltage between the first and second reference voltages Vref1, Vref2, i.e., Vref1>Vout>Vref2. The output voltage Vout in the steady state corresponds to the mean value (Vref1+Vref2)/2 of the first and second reference voltages Vref1, Vref2, when the first and second transistors N0, P0 have the same threshold voltages and the same characteristics, when the first and second current mirrors 2, 3 have the same current mirror ration, and when an input current I4 of the output stage 4 is zero. Referring to the explanation below, the input current I4 of the output stage 4 is zero in the steady state when the output stage 4 is implemented with a MOS transistor. The input current I4 of the output stage 4 may be different from zero when the output stage is implemented with a bipolar transistor. In this case, or when the first and second transistors N0, P0 have different characteristics or the current mirrors have different current mirror ratios, the set-voltage may be different from the mean value of the reference voltages Vref1, Vref2.

In the steady state, the input current I4 of the output stage 4 is constant. The magnitude of the input current I4 is dependent on the implementation of the output stage 4. When, for example, the output stage 4 is implemented with a MOS transistor (in MOS technology), the input current I4 in the steady state is about zero, while the input current I4 in the steady state may be different from zero when the output stage 4 is implemented with a bipolar transistor (in bipolar technology).

For explanation purposes it is assumed, that the voltage regulator is in the steady state and that the output voltage Vout starts to decrease. In this case, the gate-source voltage of the first transistor N0 increases, while the gate-source voltage of the second transistor P0 decreases. This results in an increase of the reference current and, therefore, of the output current I2 of the first current mirror 2, and this results in a decrease of the reference current and, therefore, of the output current I3 of the second current mirror 3. Consequently, the input current I4 of the output stage 4 increases, so as to counteract the decrease of the output voltage Vout. When in the steady state the output voltage Vout starts to increase because the power consumption of the load Z decreases, the gate-source voltage of the first transistor N0 decreases, while the gate-source voltage of the second transistor P0 increases. Consequently, the output current I2 of the first current mirror 2 decreases, while the output current I3 of the second current mirror 3 increases. Thus, the input current I4 of the output stage 4 decreases (or even changes the current flow direction, in order to counteract a further increase of the output voltage Vout).

In the voltage regulator, the two transistors N0, P0 of the input stage 1 operate as source followers (emitter followers when the transistors would be implemented as bipolar transistors) that each receive one of the reference voltages Vref1, Vref2 at the gate terminal and the output voltage Vout at the source terminal. This provides for a rapid change of the conductivity of the transistors N0, P0 when the output voltage deviates from the set-voltage as defined by the first and second reference voltages Vref1, Vref2 and therefore for a fast response of the regulator to variations of the output voltage Vout.

Figure 2:
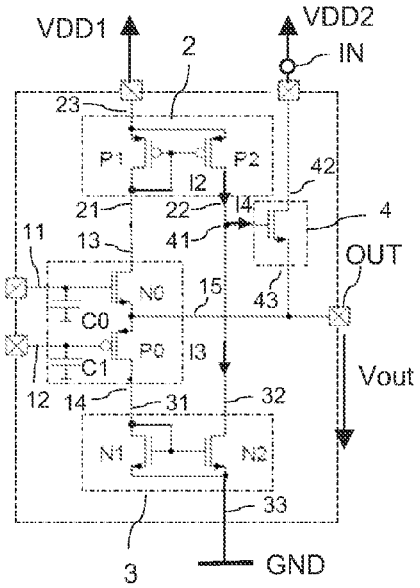
FIG. 2 shows the voltage regulator of FIG. 1, wherein embodiments of the first and second current mirrors and the output stage are illustrated in greater detail.

Embodiments of the first and second current mirrors 2, 3 and of the output stage 4 are illustrated in FIG. 2. The first current mirror 2 is implemented like a conventional current mirror with PMOS transistors. An input transistor P1 is connected as a diode and has its load path (drain-source path) connected between the reference terminal 21 and the supply terminal 23. The load path (drain-source-path of the output transistor P2) is connected between the output terminal 22 and the supply terminal 23. The control terminals (gate terminals) of the two transistors P1, P2 are connected. The second current mirror 3 is implemented like the first current mirror 2 but includes NMOS transistors. An input transistor N1 is connected as a diode and has its load path (drain-source-path) connected between the reference terminal 31 and the supply terminal 33, and an output transistor N2 has its load path (drain-source path) connected between the output terminal 32 and the supply terminal 33. The control terminals (gate terminals) of the two transistors N1, N2 are connected. The first current mirror 2 could be implemented with p-type bipolar transistors instead of PMOS transistors, and the second current mirror 3 could be implemented with n-type bipolar transistors instead of NMOS transistors as well.

According to one embodiment, the first and second current mirrors 2, 3 have identical current mirror ratios. In the current mirrors 2, 3 of FIG. 2, the current mirror ratio is defined by the ratio between the active transistor area of the input transistor P1, N1, respectively, and the active transistor ratio of the output transistor P2, N2, respectively.

In the voltage regulator of FIG. 2, the output stage 4 includes a transistor, specifically an NMOS transistor. However, this transistor could be replaced by an NPN bipolar transistor as well. A control terminal (gate terminal) of the NMOS transistor is coupled to the control terminal 41 of the output stage 4, and a load path (drain-source-path) of the NMOS transistor forms the load path 42-43 of the output stage 4. The NMOS transistor of the output stage 4 has an internal gate-source capacitance (not illustrated in FIG. 2) that can be charged or discharged through the input current I4 of the output stage 4, wherein the charging state of this gate-source-capacitance defines the load current (drain-source current) of the MOS transistor, which means the current between the input terminal IN and the output terminal OUT and, therefore, an output current Iout of the voltage regulator. The voltage regulator of FIG. 2 is in the steady state, when the input current I4 of the output stage 4 is zero, which means when a charging state of the gate-source-capacitance of the NMOS transistor of the output stage 4 remains unchanged. When the output voltage Vout decreases the input current I4 of the output stage 4 increases, so as to charge the gate-source-capacitance. In this case, the load current (drain-source current) of the NMOS transistor increases, so that the output current Iout increases in order to increase the output voltage Vout to the desired set-value. When in the voltage regulator of FIG. 2, the output voltage Vout increases, the input current I4 of the output stage 4 turns negative (flows in a direction opposite to the direction illustrated in FIG. 2), so as to discharge the gate-source-capacitance of the NMOS transistor. In this case, the load current (drain-source current) of the NMOS transistor decreases so that the output current Iout decreases, in order to decrease the output voltage Vout to the desired set-value.

By virtue of the control mechanism described before, the control circuit (which can also be referred to as an error amplifier) with the input stage 1 and the first and second current mirrors 2, 3 is capable of reacting very fast on changes of the output voltage Vout and is therefore capable to rapidly change the output current Iout so that variations of the output voltage Vout may be balanced very fast. Thus, an output capacitor that may additionally balance variations of the output voltage Vout is not required in the voltage regulator according to FIGS. 1 and 2. Although an (external) output capacitor is not required in the voltage regulator, an output capacitor may still be used if desired.

Optionally, the input stage 1 includes first and second input capacitors C0, C1, with each of these input capacitors C0, C1 connected between one of the control inputs 11, 12 and the reference potential GND. These input capacitors C0, C1 buffer the reference voltages Vref1, Vref2. Through internal gate-source capacitances (not shown) of the first and second transistors N0, P0 the feedback terminal 15 is capacitively coupled to the gate terminals of the first and second transistors N0, P0. The input capacitors C0, C1 help to avoid that fast variations of the output voltage Vout at the feedback terminal 15 result in corresponding variations of the voltages at the gate terminals of the first and second transistors N0, P0.

In the voltage regulators of FIGS. 1 and 2, the input terminal IN of the output stage 4 is a terminal to receive the positive potential of the input voltage VDD2, while the load is connected to the terminal for the negative supply potential (reference potential) GND. In these embodiments, the output stage 4 includes an NMOS transistor (or n-type bipolar transistor). The invention, however, is not restricted to have the output stage connected to the terminal for the positive supply potential. According to further embodiments, the output stage is connected to the terminal for the negative supply potential (reference potential) of the input voltage VDD2, while the load is connected between the output stage 4 and the terminal for the positive supply potential. In this case, the transistor in the output stage is implemented as a PMOS transistor (p-type bipolar transistor).

Figure 3:
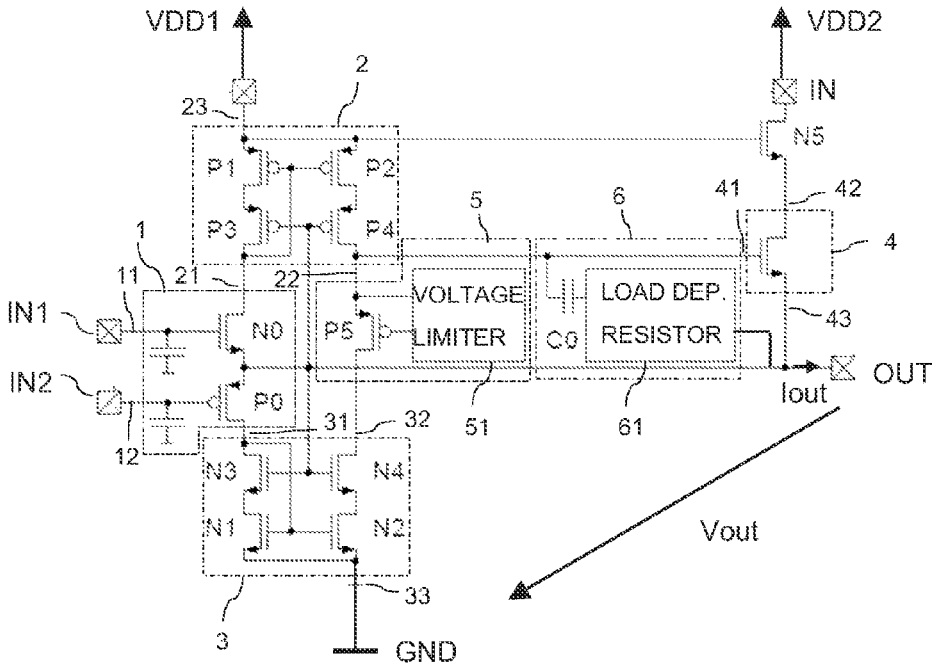
FIG. 3 illustrates a voltage regulator additionally comprising a voltage limiting circuit and a compensation circuit.

FIG. 3 illustrates a further embodiment of a voltage regulator. The voltage regulator of FIG. 3 is based on the voltage regulator of FIG. 2 and additionally includes a voltage limiting circuit 5 that is configured to limit the voltage at the control terminal 41 of the output stage 4. The voltage limiting circuit 5 is, in particular, configured to prevent the voltage at the control terminal 41 from dropping to below the output voltage Vout. The voltage limiting circuit 5 of FIG. 3 includes a transistor P5 having a load path connected between the control terminal 41 of the output stage 4 and the second current mirror 3, and a control terminal coupled to a control circuit 51. The control circuit 51 is configured to detect the voltage at the control terminal 41 of the output stage 4 and is configured to pinch off the transistor P5 when the voltage at the control input 41 decreases to the output voltage Vout, so as to prevent the voltage at the control input 41 from decreasing further.

The voltage regulator of FIG. 3 further includes a compensation circuit 6 coupled to the control terminal 41 of the output stage 4. The compensation circuit 6 includes a capacitive element C0 and a load dependent resistor 61 connected in series with the capacitive element C0. The load dependent resistor 61 has a resistive value that is dependent on a load connected to the output terminal OUT and which is, in particular, dependent on the output current Iout of the voltage regulator. The series circuit with the capacitive element C0 and the load dependent resistor 61 is connected between the control terminal 41 of the output stage 4 and either the output terminal OUT (as illustrated) of the voltage regulator or the terminal for the reference potential GND.

In the voltage regulator of FIG. 3, the first and second current mirrors 2, 3 are based on the current mirrors illustrated in FIG. 2, wherein each of the current mirrors additionally includes two (cascode) transistors P3, P4, N3, N4, respectively. In the first current mirror 2 a first transistor P3 has its load path connected between the load path of the input transistor P1 and the reference terminal 21, and a second transistor P4 has its load path connected between the output transistor P2 and the output terminal 22. These two transistors are implemented as PMOS transistors and have their gate terminals coupled to a terminal at which a regulated voltage is available, such as, e.g., to the output terminal OUT. The gate terminal of the input transistor P1 is connected to the reference terminal 21. In the second current mirror 3, a first transistor N3 has its load path connected between the input transistor N1 and the reference terminal 31 and a second transistor N4 has its load path connected between the output transistor N2 and the output terminal 32. The two transistors N3, N4 are implemented as NMOS transistors and have their gate terminals coupled to a terminal at which a regulated voltage is available, such as, e.g., to the output terminal OUT. The gate terminal of the input transistor N1 is connected to the reference terminal 31. The additional transistors P4 and N4, respectively, protect the output transistor P2, N2 of the current mirrors 2, 3 against overvoltages. When the current mirrors 2, 3 are implemented with bipolar transistors instead of MOS transistors, the transistors P3, P4 of the first current mirror 2 are replaced by PNP bipolar transistors, while the transistors N3, N4 of the second current mirror 3 are replaced by NPN bipolar transistors.

Figure 4:
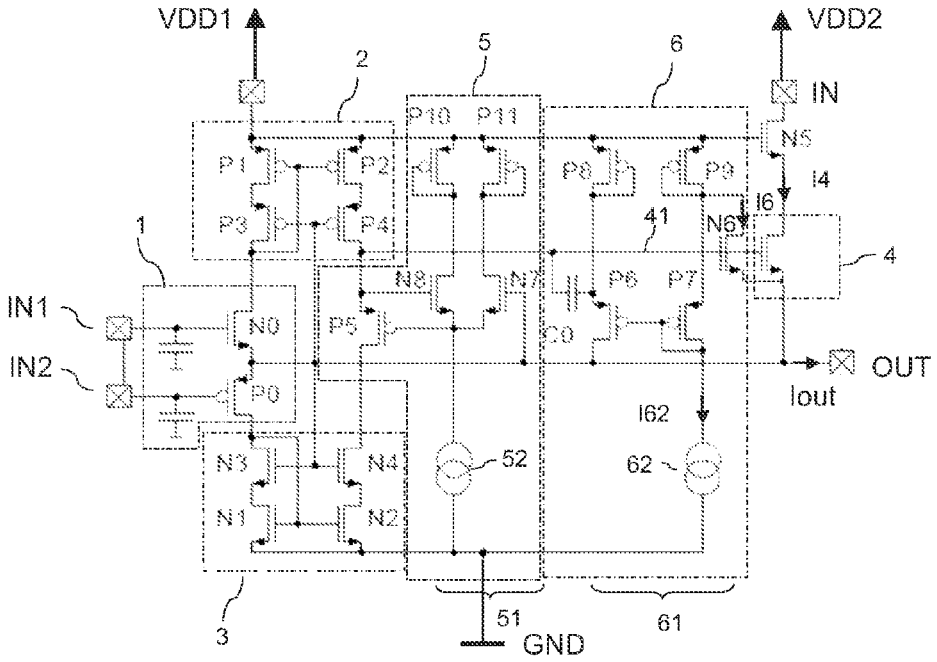
FIG. 4 illustrates the voltage regulator of FIG. 3, wherein embodiments of the voltage limiting circuit and the compensation circuit are illustrated in greater detail.

FIG. 4 illustrates the voltage regulator of FIG. 3, where the control circuit 51 of the voltage limiting circuit 5 and of the load dependent resistor 61 of the compensation circuit 6 are illustrated in greater detail. The control circuit 51 of the voltage limiting circuit includes a differential pair with two transistors N7, N8 each having its load path (gate-source-path) coupled between the first supply terminal (the VDD1 terminal) and a current source 52 connected between the load paths of the transistors N7, N8 and the second supply terminal (the GND terminal). The transistors N7, N8 of the differential pair are implemented as NMOS transistors in this embodiment, while the transistor P5 connected between the control terminal of the output stage 4 and the second current source 3 is a PMOS transistor (these transistors could be replaced by bipolar transistors). The first transistor N7 of the differential pair has its gate terminal connected to the output terminal OUT, while the second transistor N8 has its gate terminal connected to the control input 41 of the output stage 4. The gate terminal of the voltage limiting transistor P5 is coupled to a circuit note common to the transistors N7, N8 of the differential pair and the current source 52. The differential pair N7, N8 keeps the voltage limiting transistor P5 in the on-state, when the electrical potential at the control input of the output stage is higher than the output voltage Vout, while the differential pair N7, N8 pinches the voltage limiting transistor P5 off, when the voltage at the control input of the output stage 4 decreases to the output voltage Vout. When the voltage limiting transistor P5 is pinched off, a further decrease of the electrical potential at the control input 41 of the output stage 4 is prevented.

The transistors N7, N8 of the differential pair may be coupled to the first supply terminal through further transistors (PMOS transistors in this embodiment) P10, P11 connected as diodes. These transistors P10, P11 protect the transistors N7, N8 of the differential pair against overvoltages. If the voltage at the first supply terminal VDD1 is not higher than the rated voltage of the transistors N7, N8, then the transistors P10, P11 can be omitted.

Optionally, another transistor N5, that is implemented as an NMOS transistor in the embodiment of FIG. 3, has its load path connected between the output stage 4 and the input terminal IN and has its control terminal coupled to a terminal at which a regulated voltage is available, such as, e.g., to the first supply terminal (the VDD1 terminal). This transistor protects the output stage 4. In the present embodiment, this transistor N5 pinches off when a voltage at the circuit node between the transistor and the output stage reaches rises to a voltage corresponding to the supply voltage VDD1 minus the threshold voltage of the transistor N5.

Referring to FIG. 4, the load dependent resistor 61 includes a first transistor P6 having its load path connected between the capacitive element C0 and the output terminal OUT, where a circuit note common to the capacitive element C0 and the first transistor P6 is coupled to the first supply terminal through a resistive element, which is implemented as a PMOS transistor P8 connected as a diode in the embodiment of FIG. 4. The first transistor P6 is implemented as a PMOS transistor in this embodiment. The first transistor P6 is controlled dependent on the output current Iout of the voltage regulator such that the electrical potential at the circuit node common to the capacitive element C0 and the first transistor P6 decreases when the output current Iout increases, and vice versa. This can be obtained by increasing the load current (drain-source current) of the first transistor P6, when the output current Iout increases, which corresponds to increasing the gate-source-voltage of the first transistor P6.

In the compensation circuit of FIG. 4, the gate potential of the first transistor P6 is controlled dependent on the output current Iout. For this, a second transistor P7, a third transistor P9 and a current source 62 are connected in series between the first supply and second supply terminals. Both of the second and third transistors P7, P9 are connected as diodes, where a control terminal (gate terminal) of the second transistor P7 is connected to the gate terminal of the first transistors. Like the first transistor P6, the second and third transistors P7, P9 are PMOS transistors in the present embodiment. In general, the first transistor P6 and the second transistor P7 are transistors of the same type. In the embodiment of FIG. 4, the third transistor P9 and a fourth transistor P8 are transistors of the same type as the first and second transistors P6, P7. However, these third and fourth transistors P9, P8 act as resistors and may be replaced by any other pair of (matched) resistors, which is explained with reference to FIGS. 5 and 6 below.

In the present embodiment, the fourth transistor P8, that is also connected as a diode, connects the load path of the first transistor to the first supply terminal (the VDD1 terminal).

Referring to FIG. 4, the compensation circuit 6 further includes a current sense transistor N6. The current sense transistor N6 is of the same transistor type as the transistor of the output stage 4 (which is an NMOS transistor in this embodiment), has its drain terminal coupled to a circuit node common to the second and third transistors P7, P9, and has its gate-source path connected in parallel with the gate-source path of the output stage 4 transistor. Thus, the output stage 4 transistor and the current sense transistor N6 are operated in the same operating point. A current through the current sense transistor N6 is therefore proportional to the current through the output stage 4, and is dependent on the output current Iout, i.e.:

$$Iout=I4+I6 \quad (1)$$

$$I4/I6=p \quad (2),$$

where I4 is the current through the output stage 4, I6 is the current through the sense transistors 6, and p is a proportionality factor, where p is defined by ratio between an active area of the output stage 4 transistor and the active area of the sense transistor 6. Usually p is much higher than 10, such, e.g., higher than 100 ($10^2$), higher than 1000 ($10^3$), higher than 10000 ($10^4$), or even higher than 100000 ($10^5$). The current I6 through the sense transistor is, therefore, approximately proportional to the output current Iout.

In the compensation circuit of FIG. 4, the current source 62 drives a defined current I62 through the second and third transistor P7, P9, where additionally to the current I62 of the current source 62 the sense current I6 flows through the third transistor P9. The electrical potential $VG_{P6}$ at the gate terminal of the first transistor P6 is given by:

$$VG_{P6}=VDD1-VGS_{P7}-VGS_{P9} \quad (3),$$

where $VGS_{P7}$ is the voltage drop (gate-source voltage) at the second transistor P7, and $VGS_{P9}$ is the voltage drop (gate-source voltage) at the third transistor P9. While the gate-source voltage $VGS_{P7}$ of the second transistor P7 is fixed and is only defined by the current I62 through the current source 62, the gate-source voltage $VGS_{P9}$ of the third transistor P9 is also dependent on the output current Iout. The gate-source voltage $VGS_{P9}$ of the third transistor P9 increases when the output current Iout increases, and decreases when the output current Iout decreases. Consequently, referring to equation (3) the gate potential $VG_{P6}$ of the first transistor P6 decreases when the output current increases, and the gate $VG_{P6}$ increases when the output current decreases. Since the source terminal of the first transistor P6 is coupled to the first supply terminal VDD1 through the fourth transistor P8, a decrease of the gate potential $VG_{P6}$ results in an increase of the gate-source voltage of the first transistor, so that at a higher output current Iout a higher current flows through the first transistor P6, so that the electrical potential at the terminal common to the first transistor P6 and the capacitive element decreases, as desired. A higher current through the first transistor P6 also results in a higher current through the fourth transistor P8. A higher current through the first and fourth transistors P6, P8 is equivalent to an increase of the transconductances and, therefore, equivalent to a decrease of the resistances of these two transistors P6, P8, so that the resistance at the circuit node common to the capacitive element C0 and the first and fourth transistors decreases. Thus, in the compensation circuit 6 of FIG. 4, the first transistor P6 is a variable resistor that is controlled dependent on the output current Iout. The series circuit with the capacitive element C0 and the variable resistor is connected between the control terminal 41 of the output stage 4 in the present embodiment. However, the series circuit could also be connected between the control terminal 41 and the second supply terminal (the GND terminal). According to a further embodiment, the current source 62 is configured to generate the current I62 dependent on the output current Iout. In this embodiment, a connection between the gate terminal of the first transistor P6 and the second transistor P7 can be omitted.

The compensation circuit with the capacitive element C0 and the load dependent resistor 61 causes a zero in the transfer function of the voltage regulator that adds to the stability of the control loop. This zero tracks and therefore compensates (in the ideal case) the load dependent output pole.

Figure 5:
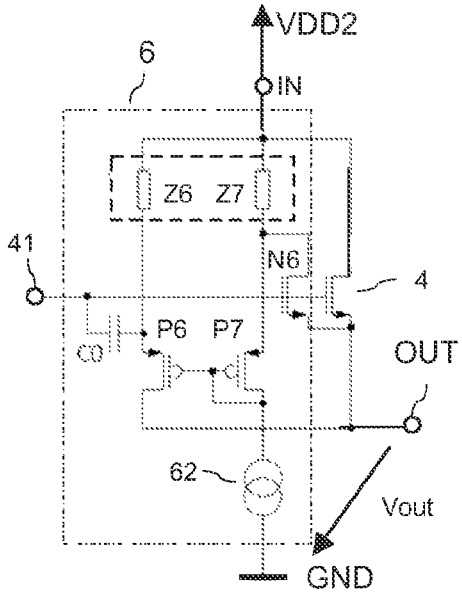
FIG. 5 illustrates a further embodiment of the compensation circuit.

Referring to FIG. 5, which illustrates a further embodiment of the compensation circuit 6, the transistors P8, P9 of FIG. 4 may be replaced by matched resistors Z6, Z7.

Figure 6:
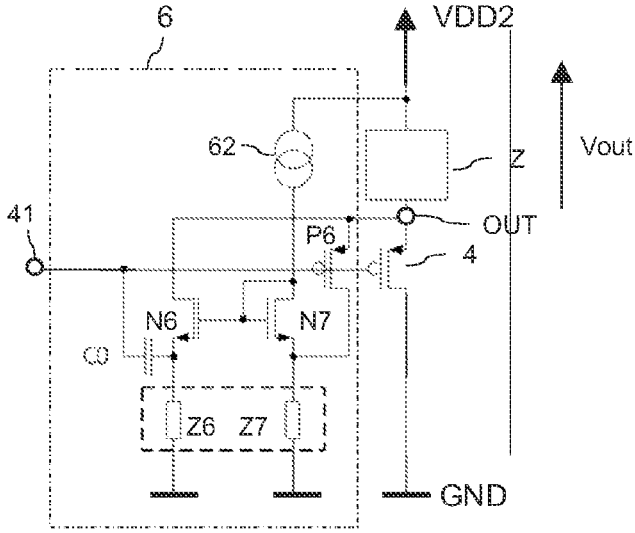
FIG. 6 illustrates another embodiment of the compensation circuit.

In the embodiments of the voltage regulator explained before, the output stage 4 includes a NMOS transistor. In this embodiment, the load Z is connected between the output terminal OUT and the terminal for the reference potential GND. According to further embodiment, the transistor of the output stage 4 can be implemented as a PMOS transistor. This embodiment, wherein only the output stage 4 is illustrated, is shown in FIG. 6. In this case, the compensation circuit 6 may be modified as illustrated in FIG. 6. In this embodiment, the load Z is connected between the output terminal OUT and the input voltage VDD2 and the output voltage Vout is referenced to the input voltage VDD2. The PMOS transistors of the compensation circuit 6 of FIG. 5 are replaced by NMOS transistors N6, N7, wherein a first one of these transistors is connected in series with a first one Z6 of the matched resistors, and wherein a second one N7 of these transistors is connected in series with a second one of the matched resistors Z7. The series circuit with the transistor N6 and the resistor Z6 is connected between the output terminal OUT and the terminal for the reference potential GND and the series circuit with the transistor N7 and the matched resistor Z7 is connected in series with the current source 62 between the terminal for the input voltage VDD2 and the reference potential GND.

Referring to FIG. 1, the first and second reference voltages Vref1, Vref2 may be generated by a reference voltage generator 7. According to one embodiment, the reference voltage generator 7 is configured to generate the first and second reference voltages Vref1, Vref2 dependent on the output voltage Vout. In this case, the reference voltage generator 7 includes a control loop for generating the first and second reference voltages Vref1, Vref2 dependent on a reference voltage and the output voltage Vout. This control loop may be implemented with digital circuit means or with analogue circuit means.

Figure 7:
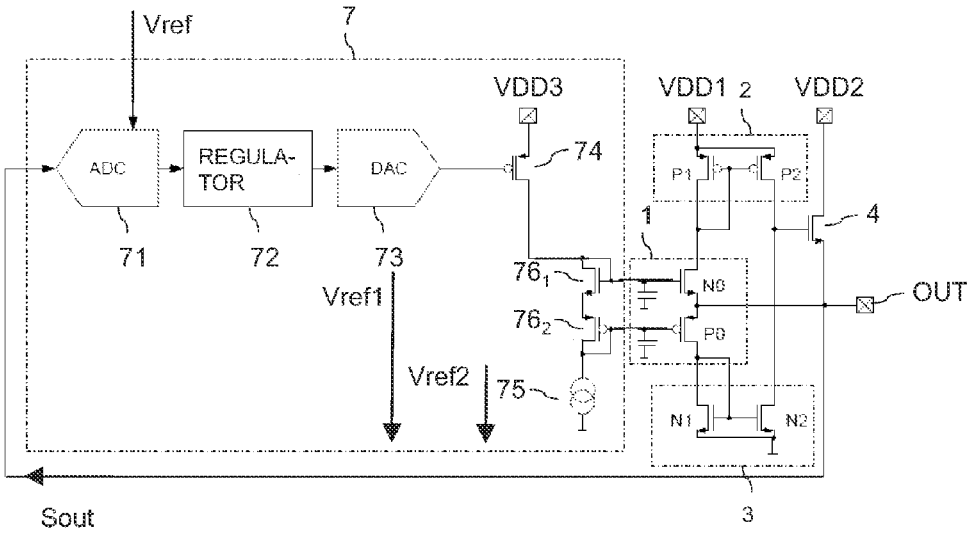
FIG. 7 illustrates a first embodiment of a voltage regulator including a reference voltage generator.

An embodiment of a reference voltage generator 7 including a digital control loop is illustrated in FIG. 7. For a better understanding, an error amplifier with an input stage 1, two current mirrors 2, 3 and an output stage 4 is also illustrated in FIG. 7. The error amplifier 1, 2, 3 and the output stage 4 of FIG. 7 are implemented as illustrated in FIG. 2. However, each of the other implementations explained before may be used as well.

The reference voltage generator of FIG. 7 includes an analog-to-digital converter (ADC) 71 receiving an output voltage signal Sout. The output voltage signal Sout may correspond to the output voltage Vout (as illustrated in FIG. 7) or may be a signal derived from the output voltage Vout. The ADC 71 further receives a reference signal Vref and generates a digital error signal from the output signal Sout and the reference voltage Vref and provides the digital error signal to a digital regulator 72. The regulator 72 may be, but is not restricted to, a regulator with a P-characteristic, a PI-characteristic, a PD-characteristic, a PID-characteristic, or an I-characteristic. The regulator 72 generates a digital control or regulation signal and provides the regulation signal to a digital-to-analog converter (DAC) 73. The DAC 73 controls a pass device 74 such as, for example, a PMOS transistor 74 connected in series with a first and a second diode $\mathbf{76}_1$, $\mathbf{76}_2$ and a current source 75. The series circuit with the pass device 74, the first and second diodes $\mathbf{76}_1$, $\mathbf{76}_2$ and the current source 75 is connected between a terminal for a further supply voltage VDD3 and the terminal for the reference potential GND. The first and second diodes $\mathbf{76}_1$, $\mathbf{76}_2$ are implemented as NMOS transistor and PMOS transistor, respectively, connected as diodes. The second reference voltage corresponds to the voltage across the current source 75, while the first reference voltage Vref1 corresponds to the second reference voltage Vref2 plus the voltage drops across the first and second diodes $\mathbf{76}_1$, $\mathbf{76}_2$. The control loop in the reference voltage generator 7 may be relatively slow as compared with the control loop in the error amplifier with the input stage 1 and the first and second current sources 2, 3. In the control loop of FIG. 7, the voltage drop across the two diodes $\mathbf{76}_1$, $\mathbf{76}_2$ is constant and is defined by the current provided by the current source 75. Thus, the difference Vref1-Vref2 between the first and second reference voltages Vref1, Vref2 is approximately constant. The voltage drop Vref2 across the current source 75 is dependent on the conductivity of the pass device 74 and decreases when the conductivity of the pass device 74 decreases (when the ohmic resistance of the pass device increases), and the voltage drop Vref2 across the current source 75 increases when the conductivity of the pass device 74 increases. The control loop with the regulator 72 is configured to increase the first and second reference voltages Vref1, Vref2 by suitably controlling the pass device 74 when the output voltage Vout falls below a voltage value defined by the reference voltage (reference signal) Vref, and to decrease the first and second reference voltages Vref1, Vref2 by suitably controlling the pass device when the output voltage Vout rises a voltage value defined by the reference voltage.

Figure 8:
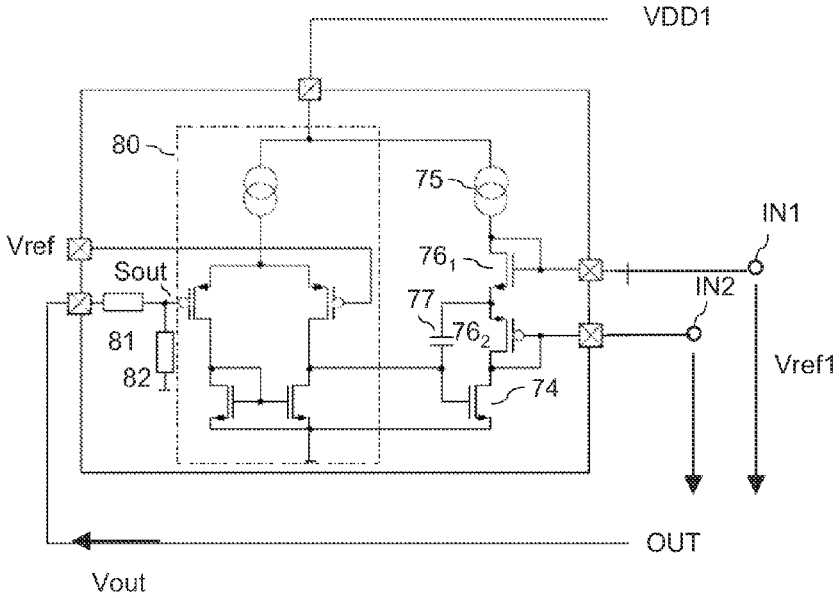
FIG. 8 illustrates a second embodiment of a voltage regulator including a reference voltage generator.

FIG. 8 illustrates a reference voltage generator 7 with an analog control loop. This control loop includes a differential amplifier 80 receiving the output voltage signal Sout at a first input and receiving the reference voltage Vref at a second input. The output voltage signal Sout is obtained from the output voltage Vout using a voltage divider with a first and a second voltage divider resistor 81, 82. The differential amplifier 80 controls the pass device 74, which in this embodiment is an NMOS transistor. Like in the embodiment of FIG. 7, the pass device 74 is connected in series with the current source 75 and the first and second diodes $\mathbf{76}_1$, $\mathbf{76}_2$. An optional capacitive element 77 connected between the control terminal of the pass device and a circuit node common to the load paths of the transistors $\mathbf{76}_1$, $\mathbf{76}_2$ contributes to the dominant pole by making use of the Miller effect with the pass device 74. The second reference voltage Vref2 corresponds to the voltage across the pass device 74, while the first reference voltage Vref1 corresponds to the second reference voltage Vref2 plus the voltage drops across the first and second diodes $\mathbf{76}_1$, $\mathbf{76}_2$. In this embodiment, the first and second reference voltages Vref1, Vref2 increase when the conductivity of the pass device 74 decreases, and vice versa.

In the embodiments explained before, each of NMOS transistors may be replaced by an NPN transistor, and each of the PMOS transistors may be replaced by a PNP transistor.

In the above detailed description, directional terminology, such as "top," "bottom," "front," "back," "leading," "trailing," "under," "below," "lower," "over," "upper," etc., is used with reference to the orientation of the figures being described. Because components of embodiments can be positioned in a number of different orientations, the directional terminology is used for purposes of illustration and is in no way limiting. It is to be understood that the features of the various exemplary embodiments described herein may be combined with each other, unless specifically noted otherwise.

Further, terms such as "first," "second," and the like, are also used to describe various elements, regions, sections, etc. and are also not intended to be limiting. Like terms refer to like elements throughout the description.

As used herein, the terms "having," "containing," "including," "comprising," and the like are open ended terms that indicate the presence of stated elements or features, but do not preclude additional elements or features. The articles "a" "an" and "the" are intended to include the plural as well as the singular, unless the context clearly indicates otherwise.

With the above range of variations and applications in mind, it should be understood that the present invention is not limited by the foregoing description, nor is it limited by the accompanying drawings. Other embodiments may be utilized and structural or logical changes may be made without departing from the scope of the present invention. The detailed description, therefore, is not to be taken in a limiting sense. Instead, the present invention is defined and limited only by the appended claims and their legal equivalents.

What is claimed is:

1. A voltage regulator, comprising:

an output terminal configured to provide an output voltage;

an input terminal configured to provide an input voltage supply potential;

an output stage comprising a control terminal and a load path, the load path coupled between the input terminal and the output terminal; and a control circuit comprising an input stage, a first current mirror, and a second current minor;

wherein the input stage comprises a first control input configured to receive a first reference voltage, a second control input configured to receive a second reference voltage, a feedback input coupled to the output terminal, a first output terminal, and a second output terminal, wherein the first current mirror comprises a reference current path coupled between a first supply terminal and the first output terminal of the input stage, and an output current path coupled between the first supply terminal and the control terminal of a pass device, wherein the second current mirror comprises a reference current path coupled between a second supply terminal and the second output of the input stage, and an output current path coupled between the second supply terminal and the control terminal, and wherein the input stage is configured to control a current through the reference current path of the first current mirror dependent on a voltage between the first control input and the feedback input, and to control a current through the reference current path of the second current minor dependent on a voltage between the second control input and the feedback input.

2. The voltage regulator of claim 1, wherein the input stage comprises:

a first transistor having a control terminal and a load path, the control terminal coupled to the first control input, and the load path coupled between the first output terminal and the feedback input; and a second transistor having a control terminal and a load path, the control terminal coupled to the second control input, and the load path coupled between the second output terminal and the feedback input.

3. The voltage regulator of claim 2, wherein the first transistor and the second transistor are complementary transistors.

4. The voltage regulator of claim 2, wherein the first and second transistors are both MOS transistors.

5. The voltage regulator of claim 2, wherein the first and second transistors are both bipolar transistors.

6. The voltage regulator of claim 1, wherein the output stage comprises a transistor with a control terminal forming the control terminal of the pass device and with a load path forming the load path of the pass device.

7. The voltage regulator of claim 6, wherein the transistor of the output stage is a MOS transistor.

8. The voltage regulator of claim 6, wherein the transistor of the output stage is a bipolar transistor.

9. The voltage regulator of claim 1, further comprising a voltage limiting circuit coupled to the control terminal of the output stage.

10. The voltage regulator of claim 9, wherein the voltage limiting circuit is configured to prevent a voltage at the control terminal of the output stage from dropping to below a voltage threshold that is dependent on the output voltage.

11. The voltage regulator of claim 1, further comprising a compensation circuit coupled to the control terminal of the output stage, the compensation circuit comprising a capacitive element and a variable resistor having a resistance value that is dependent on an output current of the voltage regulator.

12. The voltage regulator of claim 11, wherein a series circuit with the capacitive element and the variable resistor is connected between the control terminal of the output stage and the output terminal or a terminal for a supply potential.

13. The voltage regulator of claim 12, wherein the variable resistor comprises a transistor.

14. The voltage regulator of claim 1, further comprising a reference voltage generator coupled to the output terminal and configured to generate the first and second reference voltages dependent on the output voltage and a third reference voltage.

* * * * *

UNITED STATES PATENT AND TRADEMARK OFFICE

CERTIFICATE OF CORRECTION

PATENT NO. : 9,081,404 B2
APPLICATION NO. : 13/446890
DATED : July 14, 2015
INVENTOR(S) : Thomas Jackum et al.

It is certified that error appears in the above-identified patent and that said Letters Patent is hereby corrected as shown below:

In the claims

In Col. 12, line 45, claim 1, delete “and a second current minor” and insert --and a second current mirror--.
In Col. 12, line 66, claim 1, delete “minor dependent” and insert --mirror dependent--.

Signed and Sealed this
Fifteenth Day of December, 2015

Michelle K. Lee

Michelle K. Lee
*Director of the United States Patent and Trademark Office*